US007669922B2

(12) United States Patent
Murphy et al.

(10) Patent No.: US 7,669,922 B2
(45) Date of Patent: Mar. 2, 2010

(54) RECLINING SEATING UNIT WITH BACKREST SUPPORT FRAME

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 1246 days.

(21) Appl. No.: 10/982,042

(22) Filed: Nov. 5, 2004

(65) Prior Publication Data

US 2006/0108840 A1 May 25, 2006

(51) Int. Cl.
*A47C 1/02* (2006.01)

(52) U.S. Cl. ..... 297/85 R

(58) Field of Classification Search ..... 297/68, 297/83, 84, 85, 88, 89, 302.1, 325–328
See application file for complete search history.

(56) References Cited

U.S. PATENT DOCUMENTS

| | | | | | |
|---|---|---|---|---|---|
| 777,941 | A | * | 12/1904 | De Fontes | 297/68 |
| 2,906,318 | A | | 9/1959 | Schliephacke | |
| 2,948,331 | A | * | 8/1960 | Schliephacke | 297/86 |
| 3,226,155 | A | * | 12/1965 | Whiteford | 297/85 |
| 3,244,449 | A | * | 4/1966 | Re | 297/75 |
| 3,537,747 | A | | 11/1970 | Rogers, Jr. | |
| 3,603,641 | A | | 9/1971 | Knabusch | |
| 3,815,954 | A | | 6/1974 | Rogers, Jr. et al. | |
| 3,865,432 | A | * | 2/1975 | Rogers et al. | 297/316 |
| 3,937,518 | A | * | 2/1976 | Harrison | 297/61 |
| 4,477,118 | A | | 10/1984 | Ruble | |
| 4,536,029 | A | | 8/1985 | Rogers, Jr. | |
| 4,632,456 | A | * | 12/1986 | Kassai | 297/328 |
| 4,690,454 | A | * | 9/1987 | Mizelle | 297/89 |
| 4,718,716 | A | * | 1/1988 | Stumpf et al. | 297/85 |
| 4,915,444 | A | | 4/1990 | Rogers, Jr. | |
| 5,015,031 | A | * | 5/1991 | Horenkamp | 297/84 |
| 5,110,179 | A | | 5/1992 | Rogers | |

(Continued)

OTHER PUBLICATIONS

Advertisement of push-back chair in golden yellow leather from *Features/Infumiture*.
Picture of reclining chair featuring four features (Advantages).
Back page of Furniture/Today May 13, 2001, vol. 26, No. 35.

(Continued)

*Primary Examiner*—Milton Nelson, Jr.
(74) *Attorney, Agent, or Firm*—Myers Bigel Sibley & Sajovec

(57) ABSTRACT

A reclining chair includes: a base; a seat; a backrest; and a reclining mechanism attached to the base, seat and backrest. The reclining mechanism comprises a plurality of pivotally interconnected links and is configured to move the seat and backrest relative to the base between a fully upright position, in which the seat is generally horizontally disposed above the base and the backrest is generally vertically disposed at a first angle to an underlying surface above a rear portion of the backrest, and one or more reclined positions, in which the backrest is disposed at a second angle to the underlying surface, the second angle being less than the first angle. One of the links of the reclining mechanism is a backrest support link that moves in concert with the backrest between the upright and reclined positions. The backrest support link includes a first longitudinally disposed panel pivotally interconnected with at least one other link of the reclining mechanism, and further includes a second transversely disposed panel to which the backrest attaches.

37 Claims, 8 Drawing Sheets

U.S. PATENT DOCUMENTS

| | | | | |
|---|---|---|---|---|
| 5,120,107 | A | 6/1992 | Rogers, Jr. | |
| 5,857,739 | A | 1/1999 | Smith | |
| 6,957,863 | B2 * | 10/2005 | Heidmann et al. | 297/300.1 |

OTHER PUBLICATIONS

Furniture/Today Apr. 15, 2002, vol. 26, No. 32, p. 135 (Hjellegjerde).
Furniture/Today Apr. 15, 2002, vol. 26, No. 32, p. 209 (Motion).
Furniture/Today Apr. 15, 2002, vol. 26, No. 32 p. 237.

* cited by examiner

RECLINING SEATING UNIT WITH BACKREST SUPPORT FRAME

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor. In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position.

Many recliner chairs, particularly older models, have been rather bulky. In many instances the bulk of the chair was necessary to cover the reclining mechanism when the chair was in the upright position. However, in some instances it has now become desirable to incorporate a slimmer, sleeker look into furniture, so designers of recliner chairs have responded with designs intended to present a more contemporary look. For example, U.S. Pat. No. 4,915,444 to Rogers, Jr. illustrates a three-way recliner with a "wrap-around" upholstery layer. The upholstery layer is attached at one end to the rear portion of the seat and at its other end to the front end of the footrest. In the upright position, the footrest folds under the front portion of the seat in a generally horizontal disposition, such that the upholstery layer covers the upper surface of the seat, the lower surface of the footrest, and the front surface of the chair between the seat and the footrest. As another example, U.S. Pat. No. 6,540,291 to Hoffman illustrates a contemporary "off-the-floor" style chair with three-way reclining capability.

One especially popular contemporary chair style is the "Eames" lounge chair. An Eames chair is characterized by a seat and a backrest having a relatively thin profile. In some instances the backrest is attached to the seat by one or more stems that emerge from the rear portion of the seat and attach to the rear surface of the backrest, which can provide a gap between the seat and the backrest for styling purposes. Often an Eames lounge chair will be accompanied by a separate ottoman or footstool.

Because of the thin seat and backrest profile and the styling gap, introducing reclining capability into an Eames chair presents difficulties. Given the popularity of this chair style, it would be desirable to provide an Eames chair or a similarly thin-profiled chair with reclining capability.

SUMMARY OF THE INVENTION

The present invention can provide an Eames-style chair with reclining capability. As a first aspect, embodiments of the invention are directed to a reclining chair that comprises: a base; a seat; a backrest; and a reclining mechanism attached to the base, seat and backrest. The reclining mechanism comprises a plurality of pivotally interconnected links and is configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle. One of the links of the reclining mechanism is a backrest support link that moves in concert with the backrest between the upright and reclined positions. The backrest support link includes a first longitudinally disposed panel pivotally interconnected with at least one other link of the reclining mechanism, and further includes a second transversely disposed panel to which the backrest attaches.

As a second aspect, embodiments of the present invention are directed to a reclining chair that comprises: a base; a seat having a seat frame that includes a transversely-extending rear cross-member at a rear end portion thereof a backrest; and a reclining mechanism attached to the base, seat and backrest. The reclining mechanism comprises a plurality of pivotally interconnected links and is configured to move the seat and backrest relative to the base between a fully upright position, in which the seat is generally horizontally disposed above the base and the backrest is generally vertically disposed at a first angle to an underlying surface above the rear end portion of the seat, and one or more reclined positions, in which the backrest is disposed at a second angle to the underlying surface, the second angle being less than the first angle. The backrest includes a backrest support frame that supports and moves with the backrest between the upright and reclined positions. The backrest support frame includes a transitional portion that extends from a location rearward of the rear cross-member of the seat frame to a location forward of the rear cross-member of the seat frame.

As a third aspect, embodiments of the present invention are directed to a reclining chair that comprises: a base; a seat; a backrest; and a reclining mechanism attached to the base, seat and backrest. The reclining mechanism comprises a plurality of pivotally interconnected links and is configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle. One of the links of the reclining mechanism is a backrest support link that moves in concert with the backrest between the upright and reclined positions. The backrest support link has an uppermost portion that remains below the seat in the upright and reclined positions.

As a fourth aspect, embodiments of the present invention are directed to a reclining chair that comprises: a base; a seat; a backrest; and a reclining mechanism attached to the base, seat and backrest. The reclining mechanism comprises a plurality of pivotally interconnected links and is configured to move the sear and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle. The backrest includes a backrest panel having a rear external surface and a backrest support frame. The backrest support frame is attached to the reclining mechanism and to the rear external surface of the backrest panel.

As a fifth aspect, embodiments of the present invention are directed to a reclining chair comprising: a base; a seat; a backrest; and a reclining mechanism attached to the base, seat and backrest. The reclining mechanism comprises a plurality of pivotally interconnected links and is configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle. In the upright position, the reclining mechanism folds such that an uppermost portion thereof and a lowermost portion thereof define a vertical dimension of less than about 6.5 inches.

DETAILED DESCRIPTION OF EMBODIMENTS OF THE INVENTION

Figure 1:
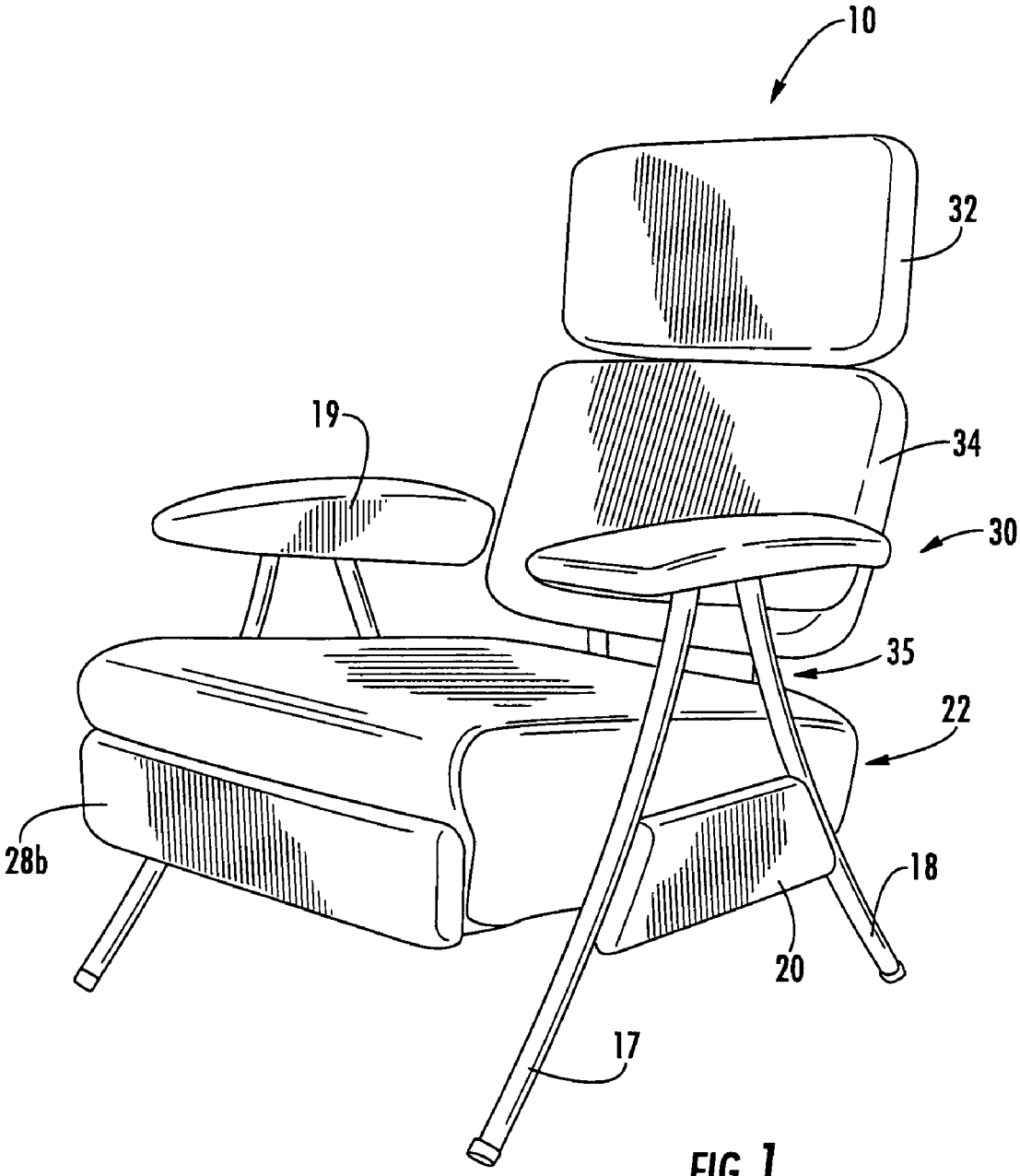
FIG. 1 is a perspective view of an embodiment of a reclining chair of the present invention, wherein the chair is shown in the upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane. Where used, the terms "attached", "connected", "interconnected", "contacting", "coupled", "mounted" and the like can mean either direct or indirect attachment or contact between elements, unless stated otherwise.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a chair, designated broadly at 10, is illustrated in FIGS. 1-6. The chair 10 includes a base 12, a seat 22, a backrest 30, two ottomans 28*a*, 28*b*, and a pair of mirror image reclining mechanisms 50. These components are described in greater detail below.

Figure 2:
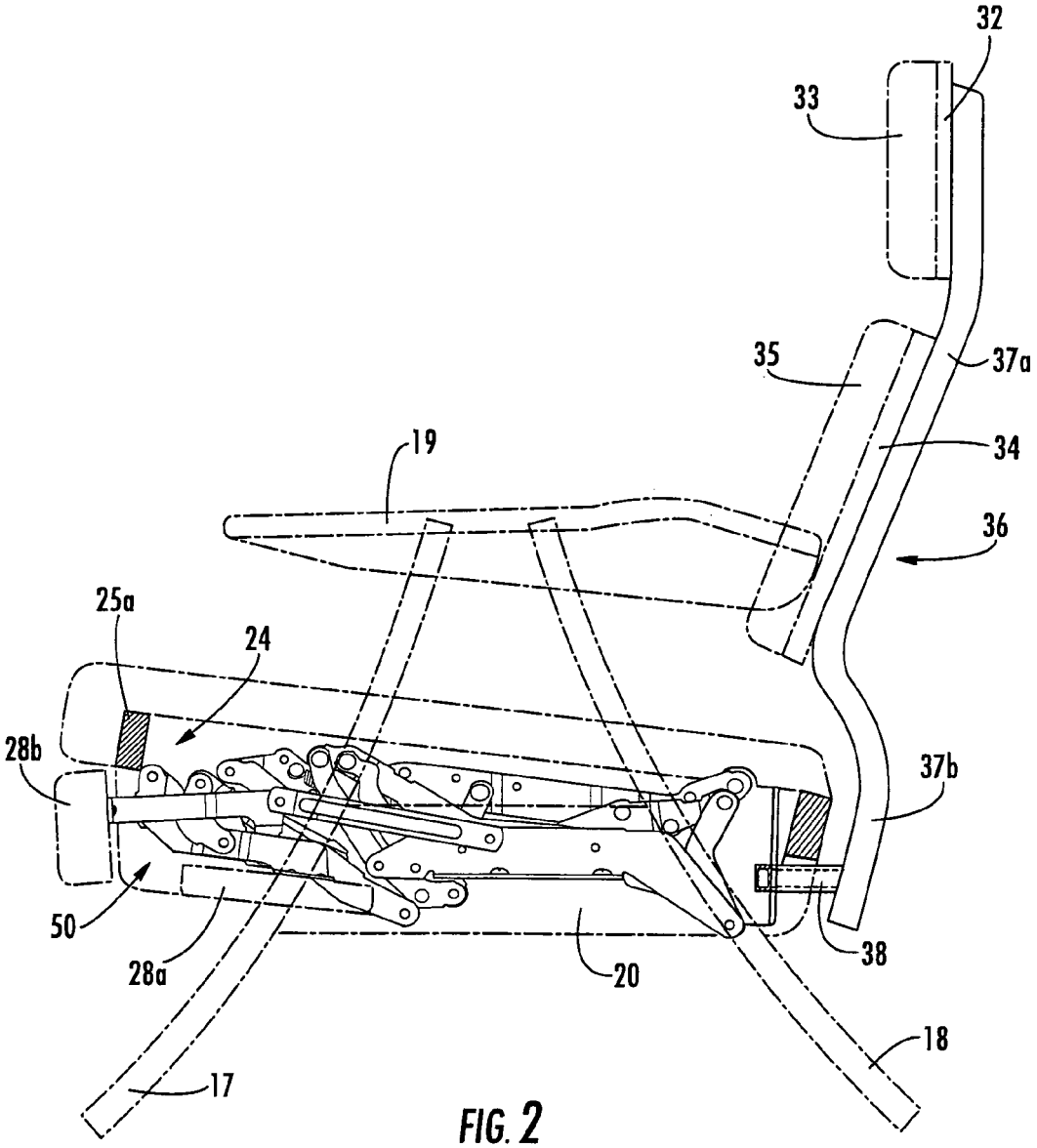
FIG. 2 is a side cutaway view of the chair of FIG. 1 with the chair in the upright position.
Figure 2A:
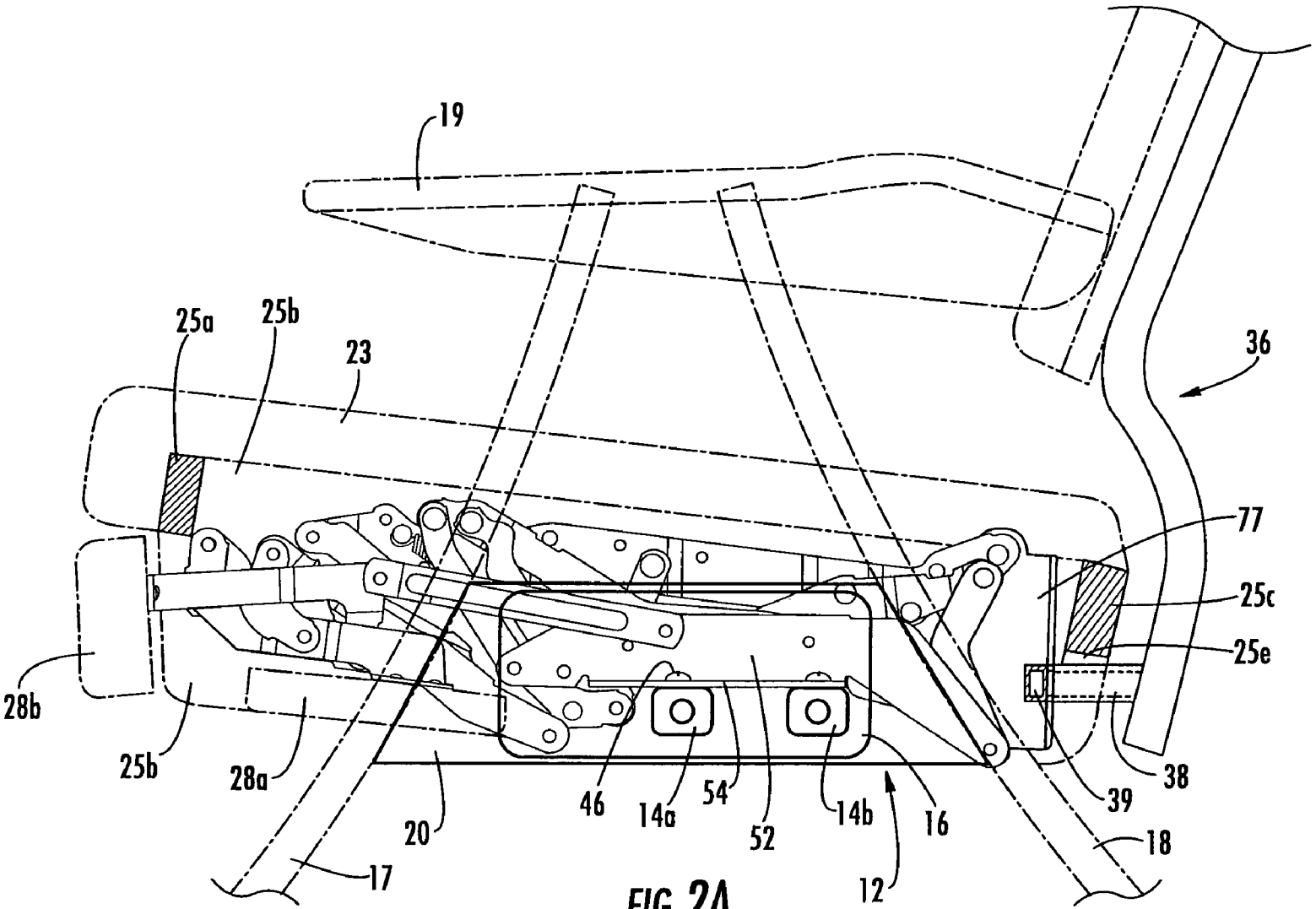
FIG. 2A is an enlarged side cutaway view of the chair of FIG. 1 showing the base.

Referring now to FIGS. 1, 2 and 2A, the base 12 includes two transversely-extending cross-members 14*a*, 14*b* that terminate at each end in joints with mounting plates 16. The base 12 is mounted off the ground via each of the mounting plates 16 being mounted flush to a trapezoidal brace panel 20. Each brace panel 20 abuts and is fixed to a forward leg 17 and a rear leg 18. The legs 17, 18 splay apart at their lower ends and approach each other at their upper ends. An arm 19 is mounted on the upper ends of each pair of forward and rear legs 17, 18.

Those skilled in this art will appreciate that the base 12 and legs 17, 18 may take any number of different forms. For example, the legs may take a different shape and/or form, may be replaced by a stationary frame that supports the cross-members 14*a*, 14*b*, or may be replaced by a central swivel unit that enables the chair to rotate about a vertical axis. As another example, the cross-members may be omitted, such that the reclining mechanisms 50 are mounted directly to the legs, which would then serve as the base. Other configurations that provide a suitable foundation for the mounting of the remaining components will be recognized by those skilled in this art and need not be described in detail herein.

Referring once again to FIGS. 2 and 2A, the seat 22 includes an upper cushion 23 that covers a seat frame 24. In this embodiment, the seat frame 24 is an open rectangular box that has a front cross-member 25*a*, side rails 25*b*, and a rear cross-member 25*c*. The side rails 25*b* have recesses (not shown) in their lower edges within which the cross-members 14*a*, 14*b* can reside. Also, the rear cross-member has slots 25*e* or other voids in its lower edges (see FIG. 5). Mounting rails are mounted on the inner surfaces of the side rails 25*b*.

Those skilled in this art will recognize that the seat 22 and seat frame 24 may take other forms. As one alternative, the mounting rails 26 may be omitted. As another alternative, the side rails 25*b* may take a simpler form with a straight lower edge. Further, the slots 25*e* may take the form or holes or apertures rather than being open ended. Other configurations, including those in which the seat frame is not rectangular, that support a seated occupant and provide suitable locations for the mounting of other components, such as the reclining mechanisms 50, may also be employed.

Figure 2B:
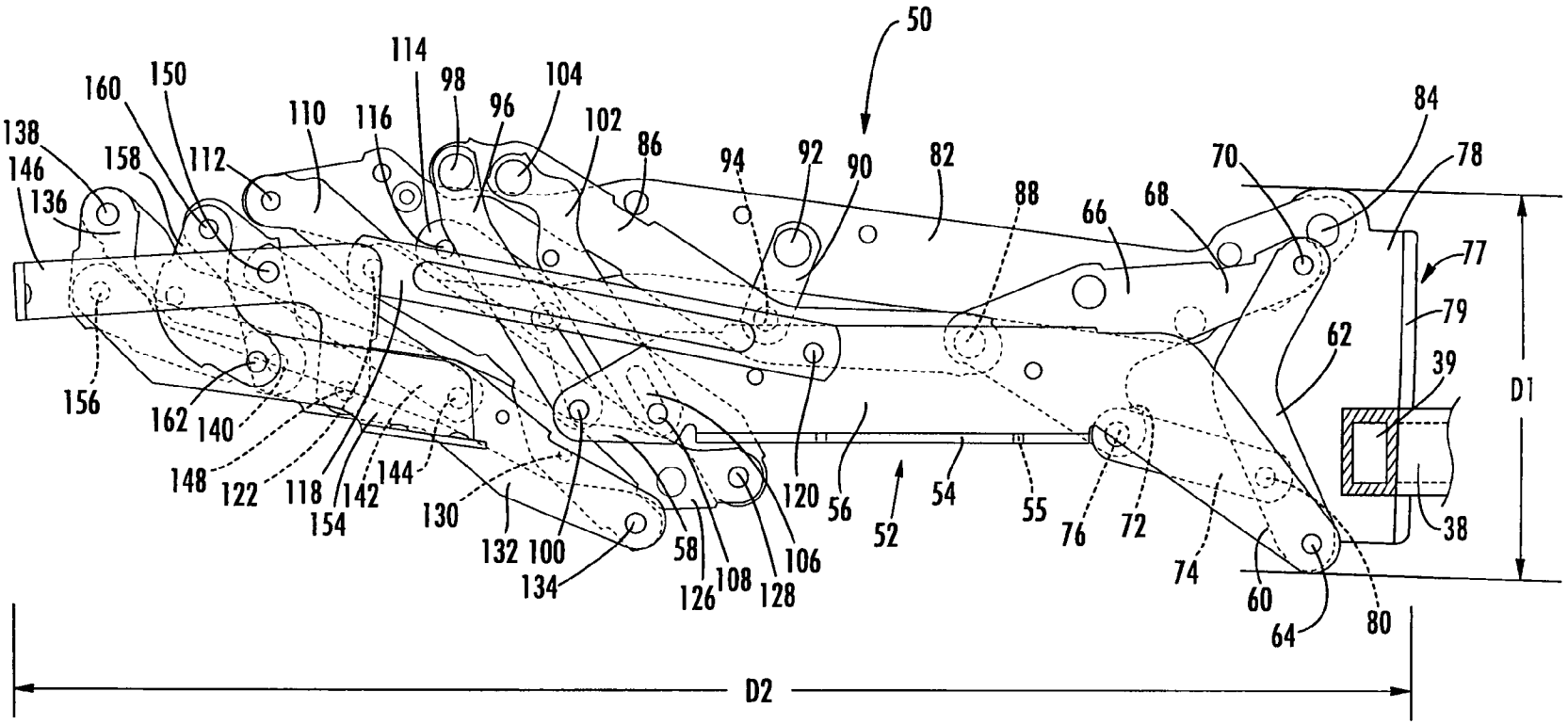
FIG. 2B is a further enlarged side cutaway view of the chair of FIG. 1 with the links of the reclining mechanism illustrated.

Referring still to FIGS. 2A and 2B, the ottomans 28*a*, 28*b* are upholstered and illustratively include cushions. They are mounted onto links of the reclining mechanisms 50 as described below. Notably, the ottoman 28*a* is longer than the ottoman 28*b*, as the ottoman 28*b* serves as the front panel of the chair 10 in the upright position and, therefore, is limited in length to the height of the seat 22. However, this configuration may be altered in other embodiments.

Referring again to FIG. 2, the backrest 30 includes a transversely-extending upper panel 32 with a cushion 33 on its front surface, a lower panel 34 with a cushion 35 on its front surface, and a backrest support frame 36. The backrest support frame 36 is generally upright and is mounted via two upper segments 37*a* to the rear surfaces of the upper and lower panels 32, 34. In the illustrated embodiment, the lower panel 34 is mounted such that there exists a gap 35 between the lower edge of the lower panel 34 and the upper surface of the seat cushion 23; this gap 35, which in this embodiment is interrupted only by the upper segments 37*a*, may be desirable in certain designs and styles.

Figure 3:
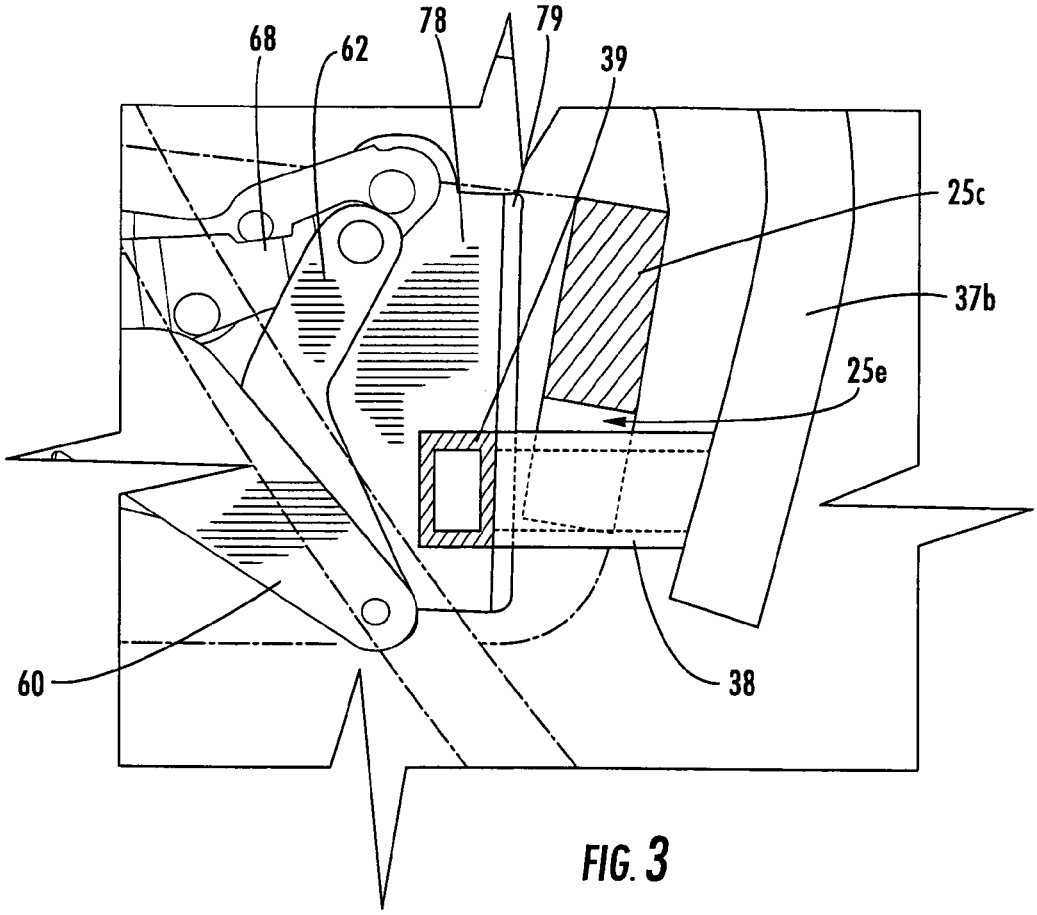
FIG. 3 is a greatly enlarged side section view of the backrest support frame and rear cross-member of the seat frame of the chair of FIG. 1, with the chair shown in the upright position.
Figure 3A:
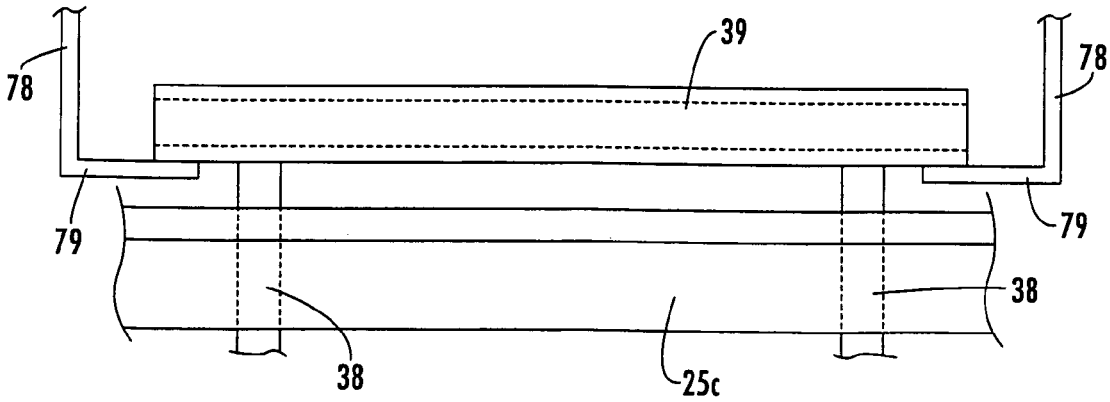
FIG. 3A is an enlarged partial top view of the backrest support frame and rear cross-member of the chair of FIG. 1.

The backrest support frame 36 also includes two lower segments 37*b* that are offset rearwardly from respective upper segments 37*a*. A transitional portion 38 extends forwardly from each of the lower segments 37*b*. A cross-member 39 spans the forward ends of the transitional portion 38. As can be seen in FIGS. 3 and 3A, when the chair 10 is in the upright position, the transitional portions 38 of the backrest support frame 36 reside within the slots 25*e* in the rear cross-member 25*c* of the seat frame 24 below the upper edge thereof.

Those skilled in this art will recognize that other backrest configurations may also be suitable. For example, the backrest may include only a single backrest panel and cushion, or three or more cushion/panel combinations. For any of these variations, one or more of the cushions may be omitted. The styling gap 35 may be omitted. The shape and form of the backrest frame may be modified, and may even be formed as a unitary structure with one or more of the backrest panels. The transitional portions 38 that couple the backrest 30 with the reclining mechanisms 50 may take a different form; they may even travel underneath the seat frame 24 rather than through a void therein as they extend from a position rearward of the seat frame rear cross-member 25*c* to a position forward of the seat frame rear cross-member 25*c*.

Referring now to FIGS. 2-6, the chair 10 includes the reclining mechanisms 50 discussed above that enable the chair 10 to move between upright, TV and fully reclined positions (i.e., the reclining mechanisms 50 are three-way reclining mechanisms). The reclining mechanisms 50, only one of which is illustrated herein, are mirror images of one another about a vertical plane that extends longitudinally through the center of the chair 10. As such, only one reclining mechanism 50 will be described herein, with the understanding that those skilled in the art will recognize that this discussion is equally applicable to the reclining mechanism 50 also.

Further, in the interest of clarity, initially the mechanism 50 will be described with respect to FIGS. 2-3A, in which the chair 10 is in its upright position; thus, the individual links comprising the mechanism 50 will be described with respect to the orientation shown in FIG. 2B. Subsequently the positions and orientations of the individual links will be described with respect to FIGS. 4 and 5, in which the chair 10 is illustrated in its TV and fully reclined positions, respectively.

The reclining mechanism 50 includes linkages that control the movement of the seat frame 24 relative to the base 12, the movement of the ottomans 28*a*, 28*b* relative to the seat frame 24, and the backrest 30 relative to the seat frame 24. The functions of each of the links comprising these linkages will be explained below.

Referring now to FIG. 2B, the reclining mechanism 50 includes a mounting bracket 52 having a horizontal panel 54 and a vertical panel 56. The horizontal panel 54 includes mounting apertures that are aligned above the cross-members 14*a*, 14*b* of the base 12 and receive fasteners 46. The vertical panel 56 of mounting bracket 52 is positioned laterally of the horizontal panel 54 and includes a forward portion 58 that extends forwardly of the forwardmost cross-member 14*a* and a rear finger 60 that extends rearwardly and downwardly from the rearwardmost cross-member 14*b*. Thus, the mounting bracket 52 provides a mounting location for the remainder of the reclining mechanism 50.

Still referring to FIG. 2B, an angled rear swing link 62 is attached at one end to the rear finger 60 of the mounting bracket 52 at a pivot 64 and extends upwardly and forwardly, then upwardly and rearwardly, therefrom. The angled shape of the rear swing link 62 enables it to remain hidden behind the arm 18 when the chair 10 is in the upright position. A front swing link 96 is attached at one end of the forward portion 58 of the mounting bracket 52 at a pivot 100 and extends upwardly and forwardly therefrom. The upper ends of the rear swing link 62 and the front swing link 96 are interconnected via a slightly bent transition link 86, which is attached at its forward end to the upper end of the front swing link 96 at a pivot 98, and a full recline swing link 66, which includes a rear projection 68 and a tab 72. The rear projection 68 is attached to the end of the rear swing link 62 opposite the pivot 64 at a pivot 70. The front end of the full recline swing link 66 is attached to the rear end of the transition link 86 at a pivot 88. A short carrier link 90 extends downwardly and slightly forwardly from a pivot 92 with a seat mounting bracket 82 to a pivot 94 with the intermediate portion of the transition link 86. These links largely control the movement of the seat frame 24 relative to the base 12.

Referring again to FIG. 2B, a straight recline actuating link 74 is attached to the tab 72 of the full recline swing link 66 at a pivot 76 and extends rearwardly therefrom. A backrest support link 77 has a longitudinal panel 78 and a transverse panel 79. The lower end of the longitudinal panel 78 is pivotally attached to the rearward end of the recline actuating link 74 at a pivot 80. The seat mounting bracket 82, which extends longitudinally much of the length of the seat 22, is pivotally attached at its rear portion to an upper portion of the longitudinal panel 78 of the backrest support link 77 via a pivot 84. The transverse panel 79 of the backrest support link 77 of each reclining mechanism 50 is fixed to the ends of the cross-member 39 of the backrest support frame 36 (see also FIGS. 3 and 3A). These links are largely responsible for controlling the pivoting of the backrest 30 relative to the seat 22.

Referring yet again to FIG. 2B, the remaining links are largely responsible for the extension of the ottomans 28*a*, 28*b*. A sequencer link 102 extends generally parallel with the front swing link 96 and is connected with the transition link 86 at a pivot 104 located just rearwardly from the pivot 98. At its opposite end, the sequencer link 102 has a slot 106 that interacts with a pin 108 located at the forward end of the mounting bracket 52; in the upright position, the pin 108 is seated in the lower end of the slot 106. A front ottoman swing link 110 is attached to the forwardmost end of the seat mounting bracket 82 at a pivot 112 and extends rearwardly and downwardly therefrom. A substantially parallel rear ottoman swing link 114 is attached to the seat mounting bracket 82 at a pivot 116 positioned rearward and downward of the pivot 112. A ottoman actuator link 118 is attached to the front ottoman swing link 110 at a pivot 122 and extends rearwardly and slightly downwardly to a pivot 120 on the mounting bracket 52. A long upper ottoman extension link 126 is attached to the rear end of the rear ottoman swing link 114 at a pivot 128 and to an intermediate portion of the front ottoman swing link 110 at a pivot 130. The upper ottoman extension link 126 extends forwardly and slightly upwardly from the pivot 130 to terminate near the front end of the seat 22. A tripartite lower ottoman extension link 132 is generally parallel to the upper ottoman extension link 126 and is attached at one end to the end of the front ottoman swing link 110 at a pivot 134. An L-shaped front ottoman carrier link 136 is attached at one end to the end of the upper ottoman extension link 126 at a pivot 138, and at its other end to an intermediate portion of the lower ottoman extension link 132 at a pivot 140. The front ottoman swing link 110, rear ottoman swing link 114, upper ottoman extension link 126, lower ottoman extension link 132 and front ottoman carrier link 136 form a pantographic linkage that extends the ottomans 28*a*, 28*b* in a "scissors" fashion to a position forward of the seat frame 24. This movement is driven by the ottoman actuator link 118.

Referring further to FIG. 2B, a straight intermediate ottoman drive link 142 is attached at one end to an intermediate portion of the upper ottoman extension link 126 at a pivot 144 and extends upwardly and forwardly therefrom. An L-shaped intermediate ottoman bracket 146 is attached at one end to an intermediate portion of the lower ottoman extension link 132 and extends upwardly, then forwardly to terminate at the ottoman 28*b* located just forwardly of the seat frame 24. The intermediate ottoman drive link 142 is attached at its forward end to an intermediate portion of the intermediate ottoman bracket 146 at a pivot 150. The intermediate ottoman drive link 142 and intermediate ottoman bracket 146 are driven by the upper ottoman extension link 126 and lower ottoman extension link 132 to control the movement of the ottoman 28*b*.

A front ottoman bracket 154 is attached at a pivot 156 to the front ottoman carrier link 136. At its opposite end, the front ottoman bracket 154 is attached to the ottoman 28*a*. An L-shaped front ottoman drive link 158 is attached at one end to the end of the lower ottoman extension link 132 at a pivot 110 and at its opposite end to an intermediate portion of the front ottoman bracket 154 at a pivot 162. The front ottoman carrier link 136, front ottoman drive link 158, and front ottoman bracket 154 control the movement of the front ottoman 28*a*.

In the upright position, the reclining mechanism 50 can be folded into a relatively compact volume. In some embodiments, the distance D1 between the uppermost and lowermost points on the mechanism 50 is less then about 6.5 inches. Also, the distance D2 between the forwardmost and rearwardmost points on the mechanism 50 is less than about 24 inches. As such, the reclining mechanism 50 may be employed with an Eames-style chair with a thin profile seat 22 while the reclining mechanism 50 remains hidden from view.

Figure 4:
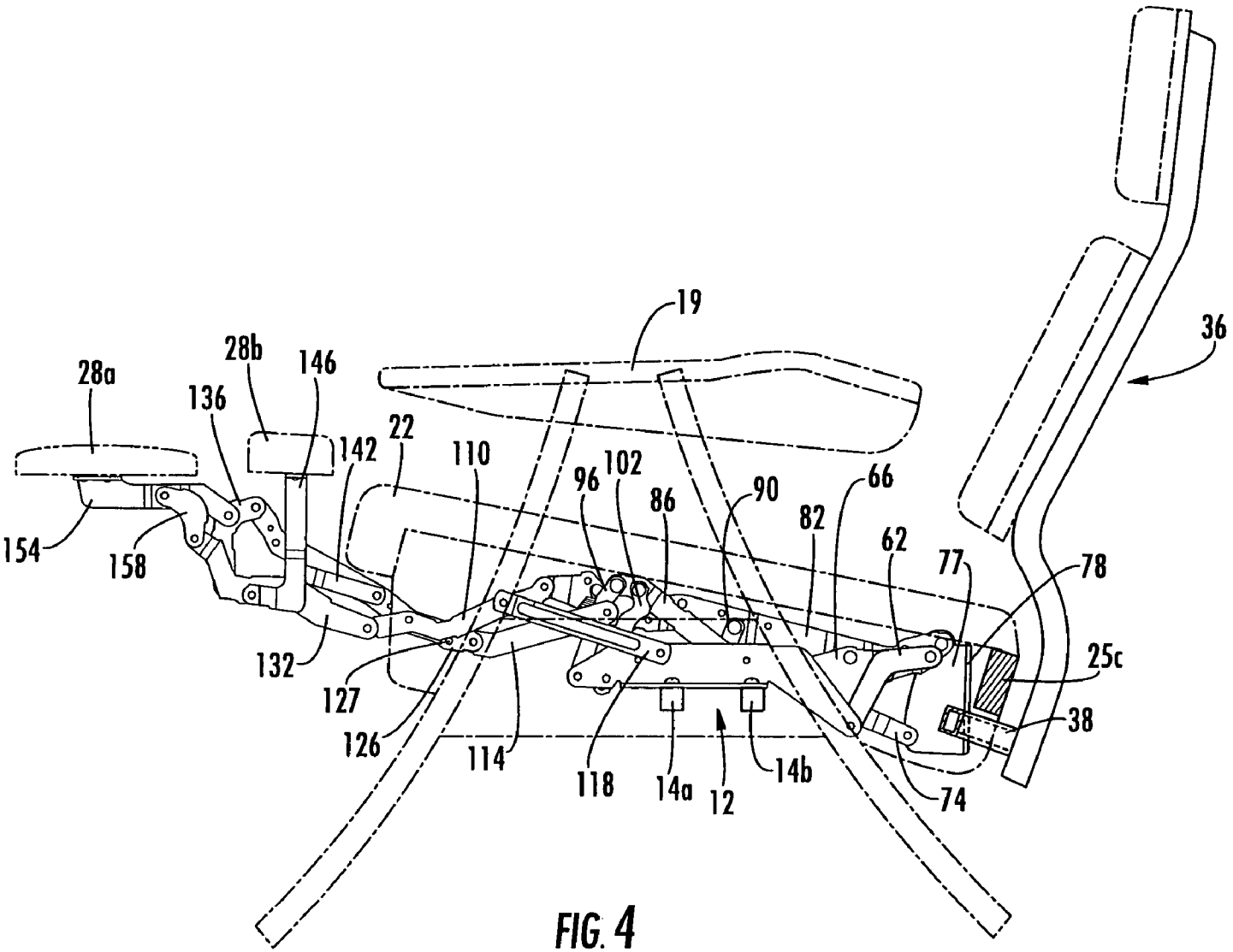
FIG. 4 is a side cutaway view of a reclining mechanism for the chair of FIG. 1 shown in the TV position.
Figure 5:
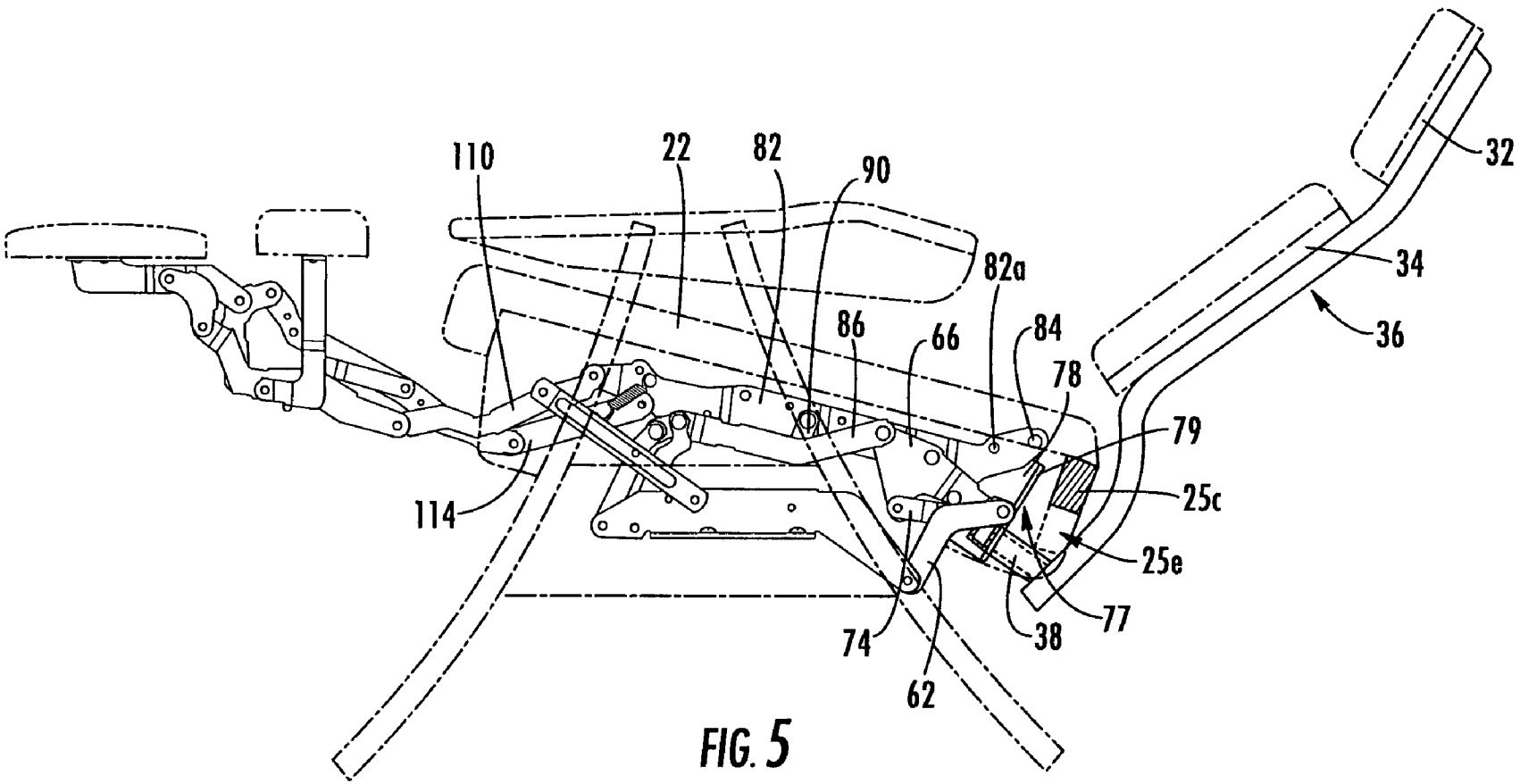
FIG. 5 is a side cutaway view of a reclining mechanism for the chair of FIG. 1 shown in the fully reclined position.
Figure 6:
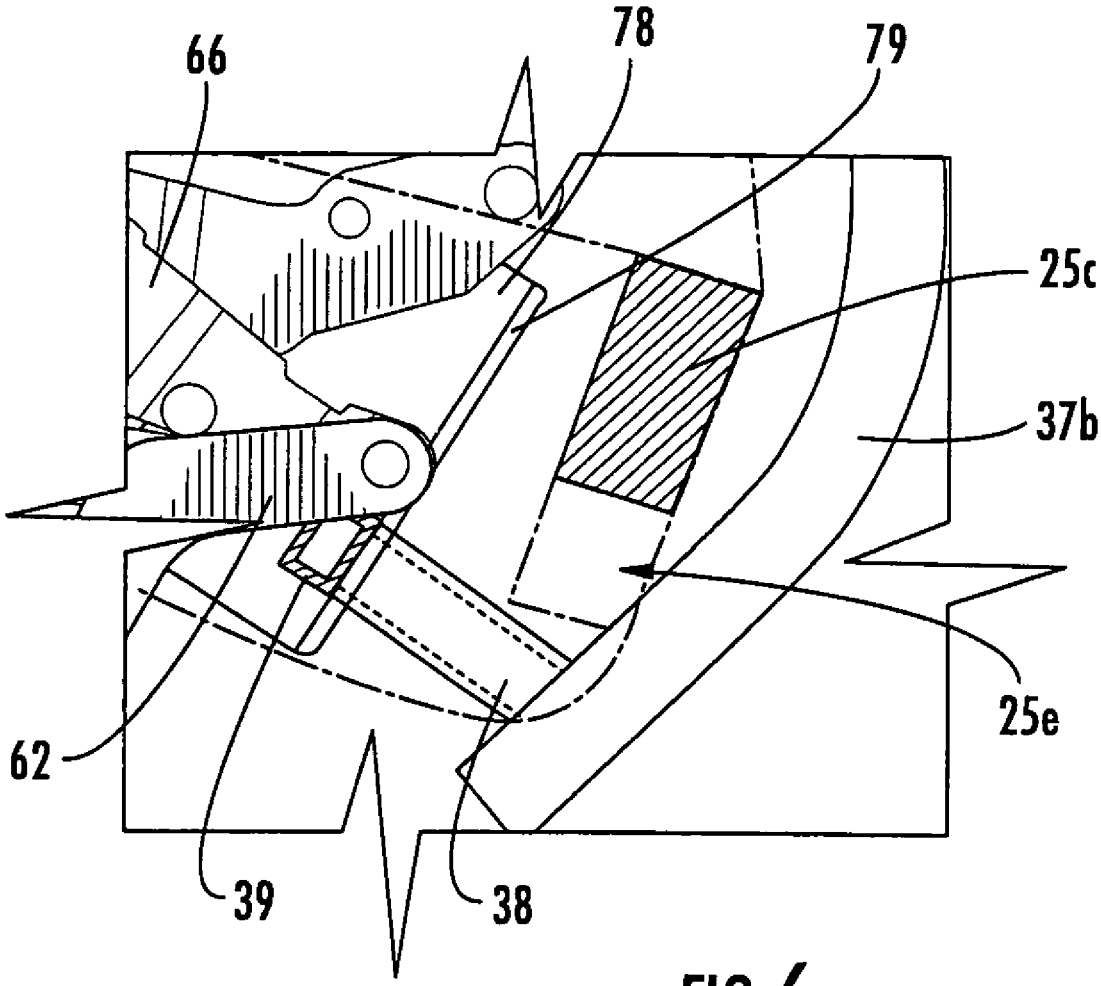
FIG. 6 is an enlarged partial section view of the chair of FIG. 1 showing the transitional portion of the backrest frame and the rear cross-member of the seat frame when the chair is in the fully reclined position.

To move the chair 10 from the upright position of FIGS. 1-3A to the TV position of FIG. 4, the occupant of the chair 10 pushes on the arms 19 while pressing back with his back on the backrest 30. This rearwardly-directed force causes the backrest support frame 36 and, in turn, the backrest support link 77 to draw the top end of the rear swing link 62 and the seat mounting bracket 82 rearwardly. After the top end of the rear swing link 62 travels rearwardly of the pivot 64, the mechanisms 50 release to the TV position, in which the seat 22 moves rearwardly relative to the base 12. The rearward movement of the rear swing link 62 draws the full recline swing link 66 and, in turn, the transition link 86 rearwardly without rotation; similarly, the carrier link 90 and the recline actuating link 74 are drawn rearwardly, but do not rotate relative to the backrest support link 77 and base 12.

The rearward movement of the transition link 86 draws the top ends of the front swing link 96 and the sequencer link 102 rearwardly. Also, the rearward movement of the seat mounting bracket 82 causes the footrest actuator link 118 to drive the lower end of front ottoman swing link 110 forward. This action causes the lower end of the upper ottoman extension link 126 to extend, thereby drawing the lower end of the rear ottoman swing link 114 forward. Extension of the upper ottoman extension link 126 also causes the front ottoman carrier link 136 to rotate (clockwise as shown in FIGS. 2B and 4), which in turn draws the lower end of the lower ottoman extension link 132 forward. The movement of the upper and lower ottoman extension links 126, 132 ceases when the front ottoman swing link 110 contacts a pin 127 located on the upper ottoman extension link 126.

As the upper and lower ottoman extension links 126, 132 extend forwardly, the intermediate ottoman drive link 142 and the intermediate ottoman bracket 146 are carried forward also. The intermediate drive link 142 substantially maintains its orientation, but the movement of the lower ottoman extension link 132 causes the intermediate ottoman bracket 146 to rotate about the pivot 148 such that the ottoman 28*b* rises and rotates to a generally horizontal disposition (the rotation is clockwise from the vantage point of FIG. 4).

Also, the extension of the upper and lower ottoman extension links 126, 132 carries the front ottoman drive link 158 and the front ottoman bracket 154 forward. As the front ottoman carrier link 136 rotates, it causes the front ottoman bracket 154 to rotate around pivot 156 (the rotation is clockwise from the vantage point of FIG. 6). This rotation is controlled by the front ottoman drive link 158, which also rotates clockwise. The rotation of the front ottoman bracket is sufficient to invert the ottoman 28*a* from a horizontal disposition in which the ottoman 28*a* faces downwardly to a horizontal disposition in which the ottoman 28*a* faces upwardly.

The chair 10 can be moved to the fully reclined position (shown in FIGS. 5 and 6) by the occupant again pushing forward on the arms 19 and rearward on the backrest 30 when the chair 10 is in the TV position. The rearward force on the backrest 30 causes, through the backrest support frame 36, the backrest support link 77 to rotate about the pivot 84 such that the upper end of the backrest support link 77 moves rearwardly and downwardly (this rotation is clockwise from the vantage point of FIGS. 5 and 6). During this movement, the transitional portions 38 of the backrest support frame 36 descend from their positions within the slots 25*e* in the rear cross-member 25*c* to allow the backrest 30 to pivot relative to the seat 22 (see FIG. 6). As such, the backrest support frame 36 and the backrest support link 77 move in concert with one another.

The pivoting of the backrest support link 77 drives the recline actuating link 74 forward, which in turn causes the full recline swing link 66 to rotate clockwise. As the front portion of the full recline swing link 66 rises, it draws the rear end of the transition link 86 upwardly. This action raises the carrier link 90, and consequently the seat mounting bracket 82 and the seat 22, upwardly and slightly rearwardly. The movement to the full recline position ceases when the longitudinal panel 78 of the backrest support link 77 strikes a pin 82*a* that is attached to the seat mounting bracket 82, at which point the seat 22 has risen about 2 inches and moved about 1 inch rearwardly.

During the movement of the chair 10 to the fully reclined position, the relationship between the front and rear ottoman swing links 110, 114 remains essentially unchanged. As a result, the ottomans 28*a*, 28*b* rise and move slightly rearwardly in synchronous motion with the seat 22 but otherwise remain extended as in the TV position of FIG. 4.

The chair 10 can be returned from the fully extended position to the TV position by the occupant pushing rearwardly on the arms 14, which reverses the motion of the aforementioned links and enables the chair 10 to take the TV position. The chair can be returned to the upright position from the TV position by the occupant pushing downwardly on the ottoman 28*a*, at which time the links described above as driving the chair to the TV position reverse their motion until the chair has returned to the upright position.

It can be seen that the reclining mechanisms 50 of chairs of the present invention can enable an Eames-style chair to include reclining capability without sacrificing the typical styling of an Eames chair. The seat and backrest can have thin profiles, and the styling gap between the seat and backrest can be maintained. As such, additional functionality can be included in an Eames-style chair.

Those skilled in this art will recognize that other reclining mechanism configurations and portions thereof may be employed with the present invention. For example, portions of a three-way mechanism illustrated in U.S. Pat. No. 4,418,957 to Rogers that move the backrest and seat relative to the base may be employed. Similarly, portions of the pressback mechanisms illustrated in U.S. Pat. No. 5,775,775 to Hoffman that extend the ottoman may be employed. Other mechanisms may also be suitable for use with the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reclining seating unit, comprising:

a base;

a seat;

a backrest;

a reclining mechanism attached to the base, seat and backrest; the reclining mechanism comprising a plurality of pivotally interconnected links and being configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle;

wherein one of the links of the reclining mechanism is a backrest support link that moves in concert with the backrest between the upright and reclined positions, the backrest support link including a first longitudinally disposed panel pivotally interconnected with at least one other link of the reclining mechanism, and further including a second transversely disposed panel to which the backrest attaches;

wherein the backrest support link has an uppermost portion that remains below the upper surface of the seat in the upright and reclined positions.

2. The seating unit defined in claim 1, wherein the reclining mechanism is a three-way reclining mechanism.

3. The seating unit defined in claim 1, wherein the backrest includes a backrest support frame, and wherein the backrest support frame is attached to the transversely disposed panel of the backrest support link.

4. The seating unit defined in claim 3, wherein the backrest support frame includes a transitional portion that extends from a location rearward of a rear cross-member of a seat frame to a location forward of the rear cross-member of the seat frame.

5. The seating unit defined in claim 4, wherein the transitional portion is positioned below an uppermost edge of the rear cross-member.

6. The seating unit defined in claim 5, wherein the transitional portion extends through a void in the rear cross-member.

7. The seating unit defined in claim 1, wherein the reclining mechanism includes an angled rear swing link.

8. The seating unit defined in claim 1, wherein the reclining mechanism folds such that an uppermost portion thereof and a lowermost portion thereof define a vertical dimension of less than about 6.5 inches.

9. The seating unit defined in claim 8, wherein the reclining mechanism folds such that a forwardmost and a rearwardmost portion thereof define a horizontal dimension of less than about 24 inches.

10. The seating unit defined in claim 1, further comprising a pair of ottomans.

11. The seating unit defined in claim 10, wherein one of the pair of ottomans has a length that is greater than a length of the other of the pair of ottomans.

12. The seating unit defined in claim 1, wherein the backrest includes a backrest panel, and wherein in the upright position the backrest panel is separated from the seat such that a visible styling gap is defined.

13. A reclining seating unit, comprising:

a base;

a seat having a seat frame that includes a transversely-extending rear cross-member at a rear end portion thereof;

a backrest;

a reclining mechanism attached to the base, seat and backrest; the reclining mechanism comprising a plurality of pivotally interconnected links and being configured to move the seat and backrest relative to the base between a fully upright position, in which the seat is generally horizontally disposed above the base and the backrest is generally vertically disposed at a first angle to an underlying surface above the rear end portion of the seat, and one or more reclined positions, in which the backrest is disposed at a second angle to the underlying surface, the second angle being less than the first angle;

wherein the backrest includes a backrest support frame that supports and moves with the backrest between the upright and reclined positions, the backrest support frame including a transitional portion that extends from a location rearward of the rear cross-member of the seat frame to a location forward of the rear cross-member of the seat frame, wherein the transitional portion of the backrest support frame extends through a void in the rear cross-member.

14. A reclining seating unit, comprising:

a base;

a seat having a seat frame that includes a transversely-extending rear cross-member at a rear end portion thereof;

a backrest;

a reclining mechanism attached to the base, seat and backrest; the reclining mechanism comprising a plurality of pivotally interconnected links and being configured to move the seat and backrest relative to the base between a fully upright position, in which the seat is generally horizontally disposed above the base and the backrest is generally vertically disposed at a first angle to an underlying surface above the rear end portion of the seat, and one or more reclined positions, in which the backrest is disposed at a second angle to the underlying surface, the second angle being less than the first angle;

wherein the backrest includes a rigid backrest support frame that supports and moves in concert with the backrest between the upright and reclined positions, the backrest support frame including a transitional portion that extends from a location rearward of the rear cross-member of the seat frame to a location forward of the rear cross-member of the seat frame, wherein the transitional portion of the backrest support frame is positioned below an uppermost edge of the rear cross-member and extends through a void in the rear cross-member.

15. The seating unit defined in claim 14, wherein the backrest includes a backrest panel, and wherein in the upright position the backrest panel is separated from the seat such that a visible styling gap is defined.

16. The seating unit defined in claim 14, wherein the reclining mechanism includes an angled rear swing link.

17. The seating unit defined in claim 14, wherein the reclining mechanism is a three-way reclining mechanism.

18. The seating unit defined in claim 14, wherein the reclining mechanism includes a backrest support link that has an uppermost portion that remains below the upper surface of the seat in the upright and reclined positions.

19. The seating unit defined in claim 18, wherein the reclining mechanism folds such that an uppermost portion thereof and a lowermost portion thereof define a vertical dimension of less than about 6.5 inches.

20. The seating unit defined in claim 19, wherein the reclining mechanism folds such that a forwardmost and a rearwardmost portion thereof define a horizontal dimension of less than about 24 inches.

21. The seating unit defined in claim 14, further comprising a pair of ottomans.

22. The seating unit defined in claim 21, wherein one of the ottomans has a length that is greater than a length of the other ottoman.

23. A reclining seating unit, comprising:

a base;

a seat;

a backrest;

a reclining mechanism attached to the base, seat and backrest; the reclining mechanism comprising a plurality of pivotally interconnected links and being configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle;

wherein one of the links of the reclining mechanism is a backrest support link that is rigidly fixed to and moves in concert with the backrest between the upright and reclined positions, the backrest support link having an uppermost portion that remains below the seat in the upright and reclined positions.

24. The seating unit defined in claim 23, wherein the backrest includes a backrest panel, and wherein in the upright position the backrest panel is separated from the seat such that a visible styling gap is defined.

25. The seating unit defined in claim 23, wherein the reclining mechanism includes an angled rear swing link.

26. The seating unit defined in claim 23, wherein the reclining mechanism is a three-way reclining mechanism.

27. The seating unit defined in claim 26, wherein the reclining mechanism folds such that an uppermost portion thereof and a lowermost portion thereof define a vertical dimension of less than about 6.5 inches.

28. The seating unit defined in claim 27, wherein the reclining mechanism folds such that a forwardmost and a rearwardmost portion thereof define a horizontal dimension of less than about 24 inches.

29. The seating unit defined in claim 23, further comprising a pair of ottomans.

30. The seating unit defined in claim 29, wherein one of the ottomans has a length that is greater than a length of the other ottoman.

31. A reclining seating unit, comprising:

a base;

a seat;

a backrest;

a reclining mechanism attached to the base, seat and backrest; the reclining mechanism comprising a plurality of pivotally interconnected links and being configured to move the seat and backrest relative to the base between a fully upright position, in which the seat is generally horizontally disposed above the base and the backrest is generally vertically disposed at a first angle to an underlying surface above a rear portion of the seat, and one or more reclined positions, in which the backrest is disposed at a second angle to the underlying surface, the second angle being less than the first angle;

wherein the backrest includes a backrest panel having a rear external surface and a backrest support frame, and wherein the backrest support frame is attached to the reclining mechanism and to the rear external surface of the backrest panel and is exposed and visible from a vantage point to the rear of the seating unit; and wherein the reclining mechanism includes an angled rear swing link, and wherein a vertex of the angled rear swing link points forwardly when the seating unit is in the upright position; and wherein the reclining mechanism includes a backrest support link that has an uppermost portion that remains below the upper surface of the seat in the upright and reclined positions.

32. The seating unit defined in claim 31, wherein the reclining mechanism is a three-way reclining mechanism.

33. The seating unit defined in claim 31, wherein in the upright position the backrest panel is separated from the seat such that a visible styling gap is defined.

34. The seating unit defined in claim 31 wherein the reclining mechanism folds such that an uppermost portion thereof and a lowermost portion thereof define a vertical dimension of less than about 6.5 inches.

35. The seating unit defined in claim 34, wherein the reclining mechanism folds such that a forwardmost and a rearwardmost portion thereof define a horizontal dimension of less than about 24 inches.

36. The seating unit defined in claim 31, further comprising a pair of ottomans.

37. The seating unit defined in claim 36, wherein one of the ottomans has a length that is greater than a length of the other ottoman.

* * * * *